United States Patent [19]

O'Meara

[11] 4,309,031

[45] Jan. 5, 1982

[54] STRIKE ZONE PAD

[76] Inventor: Maurice O'Meara, 516 Lyons Ave., Denison, Iowa 51442

[21] Appl. No.: 187,984

[22] Filed: Sep. 17, 1980

[51] Int. Cl.[3] ..... A63B 71/02

[52] U.S. Cl. ..... 273/25; 116/67 R

[58] Field of Search ..... 46/175 R; 273/26 R, 273/25; 428/17, 542; 116/67 R

[56] References Cited

U.S. PATENT DOCUMENTS

| | | | |
|---|---|---|---|
| 2,122,266 | 6/1938 | Seys | 273/25 |
| 2,515,847 | 7/1950 | Winkler | 428/17 |
| 3,091,454 | 5/1963 | Sam | 46/175 R X |
| 3,813,097 | 5/1974 | Darby | 273/25 |
| 4,161,558 | 7/1979 | See | 428/17 |
| 4,194,735 | 3/1980 | Wilson | 273/26 R |
| 4,210,322 | 7/1980 | Pritchard | 46/175 R X |
| 4,225,133 | 9/1980 | Kiray | 273/26 R |
| 4,232,068 | 11/1980 | Hoh et al. | 428/83 X |

*Primary Examiner*—Henry F. Epstein

*Attorney, Agent, or Firm*—Henderson & Sturm

[57] ABSTRACT

A strike zone pad for use in conjunction with a home plate marker to aid the umpire in calling balls and strikes in the game of slow pitch softball. The strike zone pad includes an elongated sheet having a thickness and width equal to that of the home plate marker. The strike zone pad is disposed in juxtaposed mating relationship at the rearward side of home plate terminating forward of the catcher's box and secured in position by a plurality of spikes.

7 Claims, 5 Drawing Figures

STRIKE ZONE PAD

BACKGROUND OF THE INVENTION

The present invention relates generally to sporting goods and more particularly to a device to aid the umpire in calling balls and strikes in the game of slow pitch softball.

The game of slow pitch softball has unique pitching rules. When released, the ball must be three feet above the ground and it must travel in a high arc not to exceed twelve feet in height. Since the ball is descending toward the batter at a sharp angle, it is very difficult for the umpire to call balls or strikes with consistency. Many umpires look to see where the ball lands behind the plate to aid in making their decision. However, when the chalk lines outlining the batter boxes are no longer visible, this method becomes unreliable. Those concerned with this problem recognize the need for a device to aid the umpire in the game of slow pitch softball.

SUMMARY OF THE INVENTION

The present invention provides a device to aid the umpire in calling balls and strikes in the game of slow pitch softball. The strike zone pad of this invention comprises a five-sided, flat, elongated sheet which when disposed in mating juxtaposed position at the rearward side of a home plate marker forms a composite rectangular figure. The umpire, by observing where the ball lands with respect to the strike zone pad, or by observing a distinctive sound emitted by the pad when contacted by the ball, is aided in consistently calling balls or strikes.

An object of the present invention is the provision of an improved device to aid umpires in calling balls and strikes in the game of slow pitch softball.

Another object is to provide a sports officiating aid which is easy to manufacture and maintain.

A further object is to provide a device which aids the umpire in calling balls and strikes by visual observation of the location where the ball contacts the ground.

Still another object is to provide a device which emits an audio signal which aids the umpire in calling balls and strikes.

A still further object is to provide a sports officiating aid which is easily installed and removed from a conventional softball diamond.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
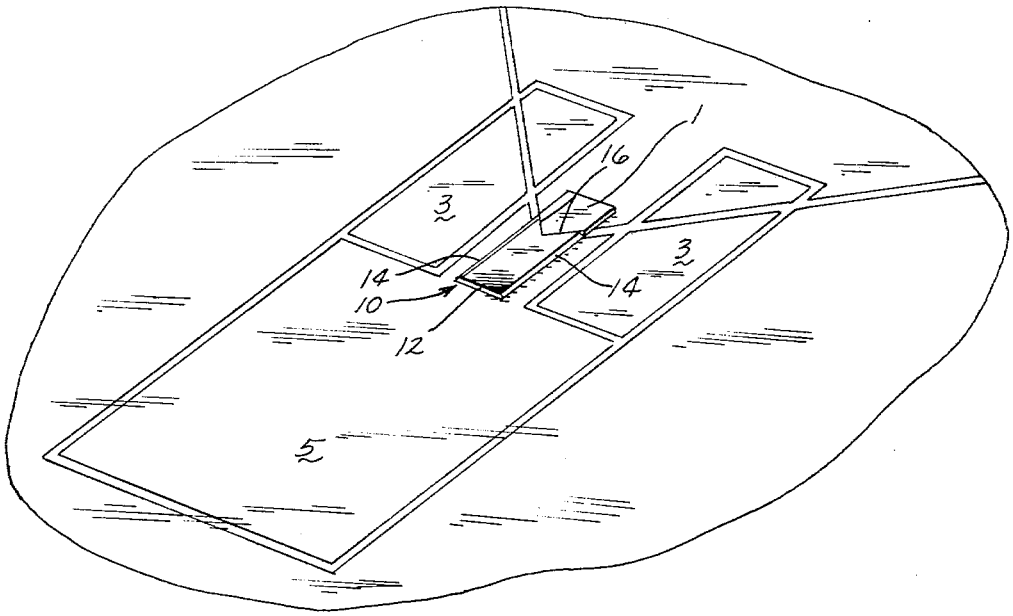
FIG. 1 is a perspective view of the strike zone pad of the present invention, wherein the strike zone pad is secured immediately behind the home plate marker between the batter boxes and forward of the catcher box.

Referring now to the drawings wherein like reference numerals designate identical or corresponding parts throughout the several views, FIG. 1 shows the strike zone pad 10 disposed in juxtaposed relationship at the rearward edge of a home plate marker 1. The strike zone pad 10 has a thickness and width equal to that of the home plate marker 1 and extends rearwardly intermediate of and parallel to the batter boxes 3. The rearward edge 12 of pad 10 terminates forward of the catcher's box 5.

Figure 2:
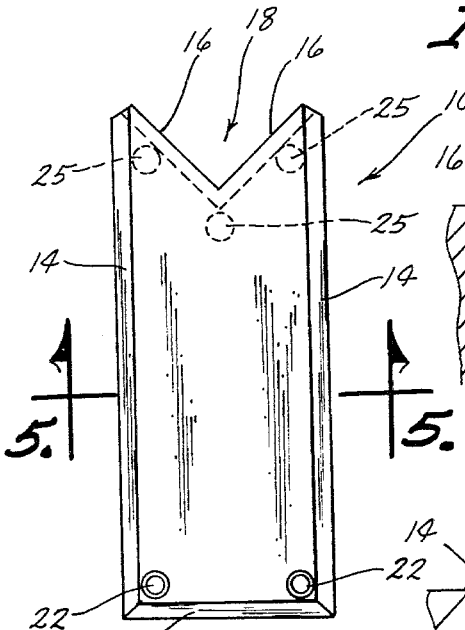
FIG. 2 is an enlarged, plan view of the strike zone pad.

As best shown in FIG. 2, the strike zone pad 10 is a five-sided, flat, elongated sheet which is made of rubber or another suitable material such as canvas. The longitudinal sides 14 are parallel with respect to each other, and when the pad 10 is in place the longitudinal sides 14 are rearward extensions of the longitudinal sides of home plate marker 1. The forward edge of pad 10 includes two sides 16 which form a v-shaped recess 18. The rearwardly directed point of home plate marker 1 mates with the v-shaped recess 18 such that when the home plate marker 1 and the pad 10 are in juxtaposed relationship they form a composite rectangular figure as shown in FIG. 1. The forward sides 16 are reverse beveled to mate with the bevel of the point of home plate marker 1, and the longitudinal sides 14 and rearward edge 12 and beveled in a manner similar to the home plate marker 1.

Figure 4:
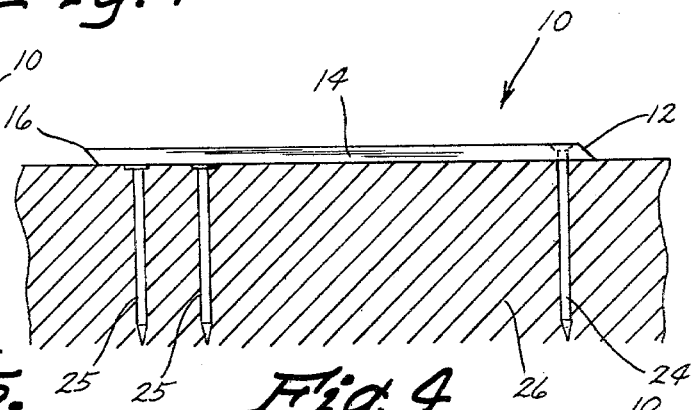
FIG. 4 is a side-elevational view similar to FIG. 3.
Figure 3:
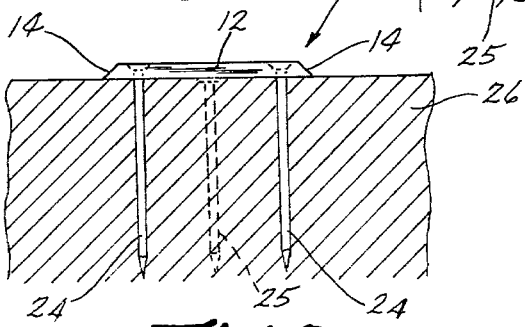
FIG. 3 is a rear-elevational view of the strike zone pad showing a plurality of ground engaging spikes securing the strike zone pad in position.

FIGS. 2–4 illustrate two alternate methods of securing the pad 10 in position behind the home plate marker 1. Near the rearward edge 12 of pad 10 a pair of aperatures 22 are formed through the pad 10 to accomodate a pair of spikes 24 which engage the ground 26 to secure the pad in position. In similar fashion, the forward end of pad 10 is secured by spikes 25 which are rigidly attached to the underside of pad 10.

Figure 5:
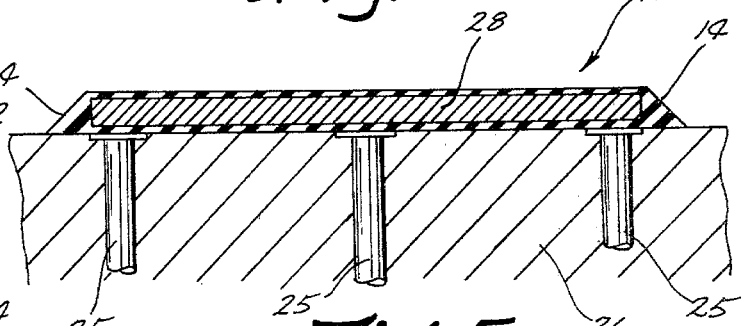
FIG. 5 is a further enlarged, sectional view taken along line 5—5 of FIG. 2, showing a signal emitter disposed within the strike zone pad and ground engaging spikes attached to the underside of the pad.

The embodiment of pad 10 shown in FIG. 5 includes a signal emitting device 28 which is disposed within the pad 10. The signal emitter 28 could include a rigid insert formed from metal or plastic that would emit a distinctive sound when struck by a ball, or a pressure sensitive electronic device that would ring or give off a swishing sound when struck.

In use for the game of slow pitch softball, the strike zone pad 10 is placed immediately behind the home plate marker 1 and secured in juxtaposed relationship thereto by ground engaging spikes 24 and 25. If the ball, when thrown by the pitcher in the required high arc, contacts the pad 10 it will be a called strike; if the ball does not contact the pad 10 it will be called a ball.

Obviously many modifications and variations of the present invention are possible in light of the above teachings. It is therefore to be understood that, within the scope of the appended claims, the invention may be practiced otherwise than as specifically described.

I claim:

1. A strike zone pad adapted for use in conjunction with a home plate marker, said pad comprising:

a flat elongated sheet of material including a v-shaped recess at the forward end thereof wherein the thickness and width of said sheet is approximately equal to the thickness and width of the home plate marker, and said sheet extends rearwardly from said home plate marker between adjacent batter box markings; and means for releasably securing said sheet in a generally mating relationship with the rearward edge of said home plate marker.

2. The strike zone pad of claim 1 further comprising: means for emitting a signal wherein said signal emitting means is disposed within said sheet.

3. The strike zone pad of claim 1 wherein said securing means includes a plurality of downwardly extending spikes attached to the underside of said sheet.

4. The strike zone pad of claim 1 wherein said securing means includes a plurality of aperatures formed in said sheet, and a plurality of spikes extending downwardly through said aperatures.

5. The strike zone pad of claim 1 wherein said sheet is formed from hard rubber material.

6. The strike zone pad of claim 1 wherein said sheet is formed from canvas material.

7. The strike zone pad of claim 2 wherein said signal emitting means is a pressure actuated audio signal emitter.

* * * * *